US011850862B2

(12) United States Patent
Horade

(10) Patent No.: US 11,850,862 B2
(45) Date of Patent: Dec. 26, 2023

(54) LIQUID EJECTION APPARATUS

(71) Applicant: BROTHER KOGYO KABUSHIKI KAISHA, Nagoya (JP)

(72) Inventor: Kenta Horade, Tokai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 88 days.

(21) Appl. No.: 17/713,380

(22) Filed: Apr. 5, 2022

(65) Prior Publication Data

US 2022/0332119 A1 Oct. 20, 2022

(30) Foreign Application Priority Data

Apr. 15, 2021 (JP) ..... 2021-068824

(51) Int. Cl.
*B41J 2/165* (2006.01)
*B41J 2/045* (2006.01)
*B41J 2/21* (2006.01)

(52) U.S. Cl.
CPC ..... *B41J 2/16579* (2013.01); *B41J 2/0451* (2013.01); *B41J 2/2142* (2013.01)

(58) Field of Classification Search
CPC ..... B41J 2/16579; B41J 2/0451; B41J 2/2142
See application file for complete search history.

(56) References Cited

U.S. PATENT DOCUMENTS 11,400,703 B2 * 8/2022 Toda ..... B41J 2/135
11,524,500 B2 * 12/2022 Nakano ..... B41J 2/0451
2007/0139461 A1 6/2007 Izuo
2014/0300657 A1 10/2014 Ike
2019/0100012 A1 4/2019 Iida

FOREIGN PATENT DOCUMENTS

JP 2007007960 A 1/2007
JP 2007152889 A 6/2007
JP 2010089376 A 4/2010
JP 2014200982 A 10/2014
JP 2017177423 A 10/2017
JP 2019064251 A 4/2019
JP 2021154640 A * 10/2021

* cited by examiner

*Primary Examiner* — Sharon Polk

(74) *Attorney, Agent, or Firm* — Scully, Scott, Murphy & Presser, PC

(57) ABSTRACT

A determination signal indicates whether each of a plurality of nozzles of a liquid ejection head is an abnormal nozzle. A controller stores, in a memory, information on a nozzle determined to be the abnormal nozzle among the plurality of nozzles; in response to receiving a particular signal and determining that the memory does not store abnormality flag information and that the number of the abnormal nozzle stored in the memory is larger than a first threshold value, control a recovery device to perform a recovery operation; and in response to receiving the particular signal and determining that the memory stores the abnormality flag information and that the number of the abnormal nozzle is larger than a second threshold value, control the recovery device to perform the recovery operation. The second threshold value is smaller than the first threshold value.

19 Claims, 8 Drawing Sheets

LIQUID EJECTION APPARATUS

CROSS REFERENCE TO RELATED APPLICATIONS

This application claims priority from Japanese Patent Application No. 2021-068824 filed Apr. 15, 2021. The entire content of the priority application is incorporated herein by reference.

BACKGROUND

A liquid ejection apparatus configured to eject liquid on a medium is known.

SUMMARY

When nozzles that do not eject liquid are detected by a liquid ejection detection unit for detecting whether liquid has been ejected from the nozzle and the number of nozzles that do not eject liquid has reached a threshold value, a liquid ejection apparatus determines whether to clean the nozzles based on preset information.

In the above liquid ejection apparatus, cleaning is performed when the number of nozzles from which liquid is not ejected reaches the threshold value and the condition preset by the user is satisfied. However, for example, even when a jam occurs during the conveyance of a medium, the liquid in the nozzles dries, and an abnormal state occurs in which the number of nozzles from which the liquid is not ejected increases rapidly, it is determined whether to clean the nozzles by using the same threshold value as the normal state. That is, cleaning of the nozzles is performed when the number of nozzles from which liquid is not ejected reaches the same threshold value as the normal state. Thus, in a situation where an abnormal state occurs and the number of nozzles from which liquid is not ejected is smaller than the threshold value at the normal state but increases suddenly, there is a high possibility that the image quality of the image formed by ejecting the liquid from the nozzles after the abnormal state occurs will be significantly lower than that before the abnormal state occurs, but cleaning of the nozzles is not performed and the deterioration of the image quality cannot be suppressed.

In view of the foregoing, an example of an object of this disclosure to provide a liquid ejection apparatus configured to suppress deterioration of image quality even if an abnormal state occurs.

According to one aspect, this specification discloses a liquid ejection apparatus. The liquid ejection apparatus includes a liquid ejection head, a signal output device, a recovery device, an abnormal-state output device, a memory, and a controller. The liquid ejection head has a plurality of nozzles configured to eject liquid. The signal output device is configured to output a determination signal when inspection driving is performed by the liquid ejection head. The recovery device is configured to perform a recovery operation of discharging liquid from the plurality of nozzles. The abnormal-state output device is configured to output an abnormality signal when an abnormal state is occurring in the liquid ejection apparatus. The controller is configured to: in response to receiving the abnormality signal from the abnormal-state output device, store, in the memory, abnormality flag information indicating that the abnormal state occurs; in response to receiving an inspection signal, perform abnormal nozzle detection of performing the inspection driving and detecting an abnormal nozzle based on the determination signal transmitted from the signal output device, the abnormal nozzle being a nozzle having an abnormality in ejection of liquid, the inspection driving being driving the liquid ejection head to eject liquid from the plurality of nozzles of the liquid ejection head for determining whether each of the plurality of nozzles is the abnormal nozzle, the determination signal indicating whether each of the plurality of nozzles is the abnormal nozzle, and store, in the memory, information on the nozzle determined to be the abnormal nozzle among the plurality of nozzles; in response to receiving a particular signal and determining that the memory does not store the abnormality flag information and that the number of the abnormal nozzle stored in the memory is larger than a first threshold value, control the recovery device to perform the recovery operation; and in response to receiving the particular signal and determining that the memory stores the abnormality flag information and that the number of the abnormal nozzle is larger than a second threshold value, control the recovery device to perform the recovery operation. The second threshold value is smaller than the first threshold value.

According to another aspect, this specification also discloses a liquid ejection apparatus. The liquid ejection apparatus includes a memory and a controller. The controller is configured to: receive an abnormality signal; in response to receiving the abnormality signal, determine that an abnormal state occurs; receive an inspection signal; in response to receiving the inspection signal: drive a liquid ejection head having a plurality of nozzles to eject liquid from the plurality of nozzles; detect an abnormal nozzle having an abnormality in ejection of liquid among the plurality of nozzles, and store, in the memory, information on a nozzle detected to be the abnormal nozzle among the plurality of nozzles; in response to receiving a particular signal and determining that the abnormal state has not occurred and that the number of the abnormal nozzle stored in the memory is larger than a first threshold value, control a recovery device to perform a recovery operation; and in response to receiving the particular signal and determining that the abnormal state has occurred and that the number of the abnormal nozzle is larger than a second threshold value, control the recovery device to perform the recovery operation. The second threshold value is smaller than the first threshold value.

According to the liquid ejection apparatus of this disclosure, when an abnormal state occurs in the liquid ejection apparatus, a recovery operation is performed when the number of abnormal nozzles is larger than the second threshold value smaller than the first threshold value which is used in a normal state when no abnormal state occurs. Thus, even if the number of abnormal nozzles suddenly increases due to the occurrence of an abnormal state, the recovery operation is likely to be performed, and the deterioration of image quality is suppressed even if the abnormal state occurs.

BRIEF DESCRIPTION OF THE DRAWINGS

Embodiments in accordance with this disclosure will be described in detail with reference to the following figures wherein.

DETAILED DESCRIPTION

Hereinafter, embodiments of this disclosure will be described.

Overall Configuration of Printer

Figure 1:
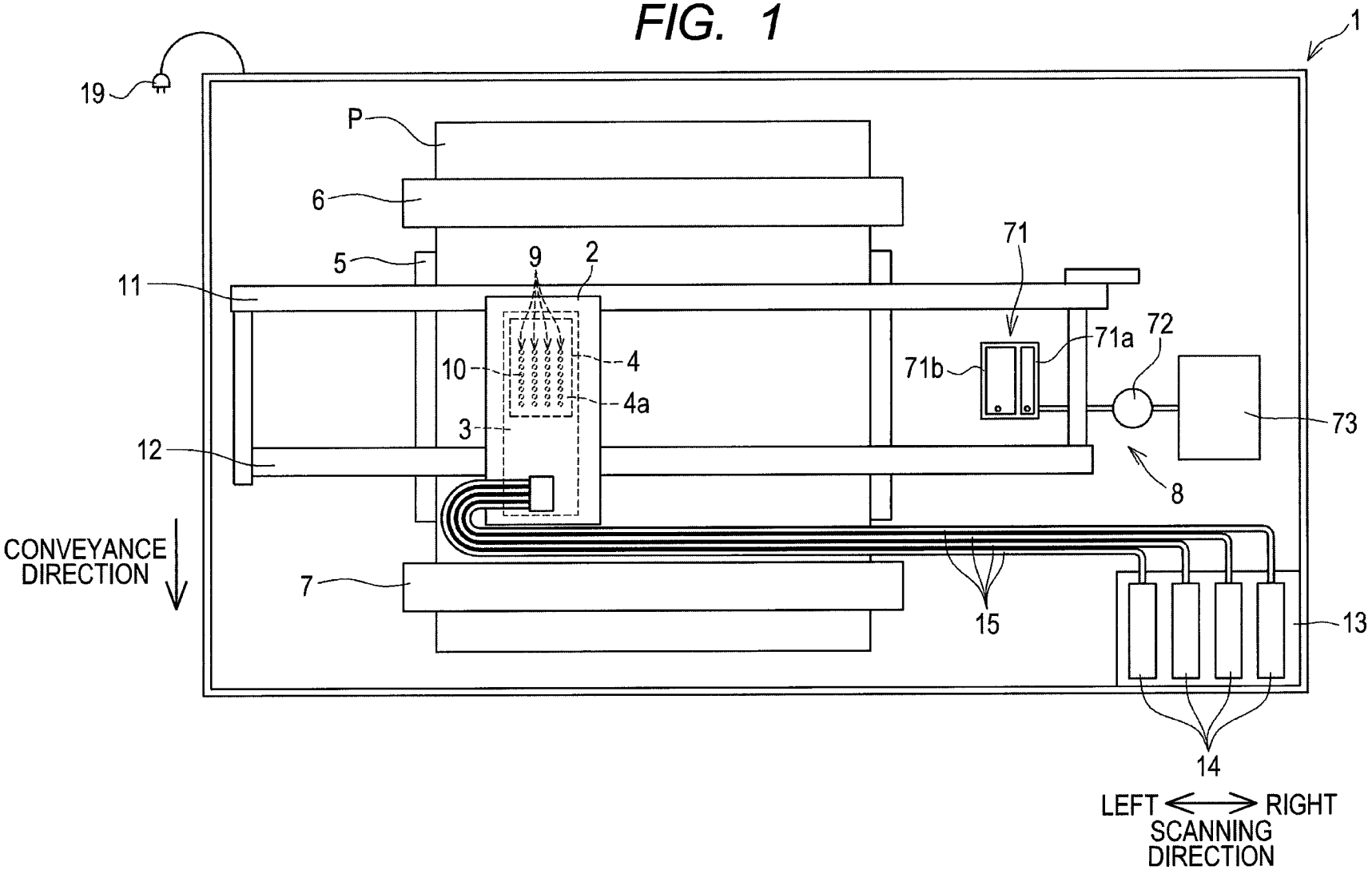
FIG. 1 is a schematic configuration diagram of a printer.

As shown in FIG. 1, a printer 1 according to a first embodiment ("liquid ejection apparatus") includes a carriage 2, a sub tank 3, an inkjet head 4 ("liquid ejection head"), a platen 5, conveyance rollers 6 and 7, a maintenance unit 8, a plug 19, and so on.

The carriage 2 is supported by two guide rails 11 and 12 extending in a scanning direction. The carriage 2 is connected to a carriage motor 86 (see FIG. 4) via a belt and so on (not shown). When the carriage motor 86 is driven, the carriage 2 moves in the scanning direction along the guide rails 11 and 12. In the following, the right side and the left side in the scanning direction are defined as shown in FIG. 1 for description.

The sub tank 3 is mounted on the carriage 2. Here, the printer 1 includes a cartridge holder 13, and four ink cartridges 14 are detachably attached to the cartridge holder 13. The four ink cartridges 14 are arranged in the scanning direction, and store black ink ("first liquid"), color ink of yellow, cyan, and magenta ("second liquid") from the one arranged at the right side in the scanning direction. The sub tank 3 is connected to the four ink cartridges 14 mounted on the cartridge holder 13 via four tubes 15. With this configuration, the ink of the above four colors is supplied from the four ink cartridges 14 to the sub tank 3.

The inkjet head 4 is mounted on the carriage 2 and connected to the lower end of the sub tank 3. The inkjet head 4 is supplied with ink of the above four colors from the sub tank 3. The inkjet head 4 ejects ink from a plurality of nozzles 10 formed on a nozzle surface 4*a* which is the lower surface of the inkjet head 4. More specifically, the plurality of nozzles 10 are arranged in a conveyance direction perpendicular to the scanning direction to form nozzle arrays 9, and four nozzle arrays 9 are arranged in the scanning direction on the nozzle surface 4*a*. Ink of black, yellow, cyan, and magenta is ejected from the plurality of nozzles 10 from those forming the nozzle array 9 at the right side in the scanning direction.

The platen 5 is arranged below the inkjet head 4 and faces the plurality of nozzles 10. The platen 5 extends over the entire width of a recording sheet P ("medium") in the scanning direction and supports the recording sheet P from below. The conveyance roller 6 is arranged upstream of the inkjet head 4 and the platen 5 in the conveyance direction. The conveyance roller 7 is arranged downstream of the inkjet head 4 and the platen 5 in the conveyance direction. The conveyance rollers 6 and 7 are connected to a conveyance motor 87 (see FIG. 4) via a gear (not shown) and so on. When the conveyance motor 87 is driven, the conveyance rollers 6 and 7 rotate, and the recording sheet P is conveyed in the conveyance direction. In this embodiment, the combination of the conveyance rollers 6 and 7 and the conveyance motor 87 is an example of "conveyor". The conveyor conveys the recording sheet P so as to pass through a region facing the plurality of nozzles 10 of the inkjet head 4.

Figure 4:
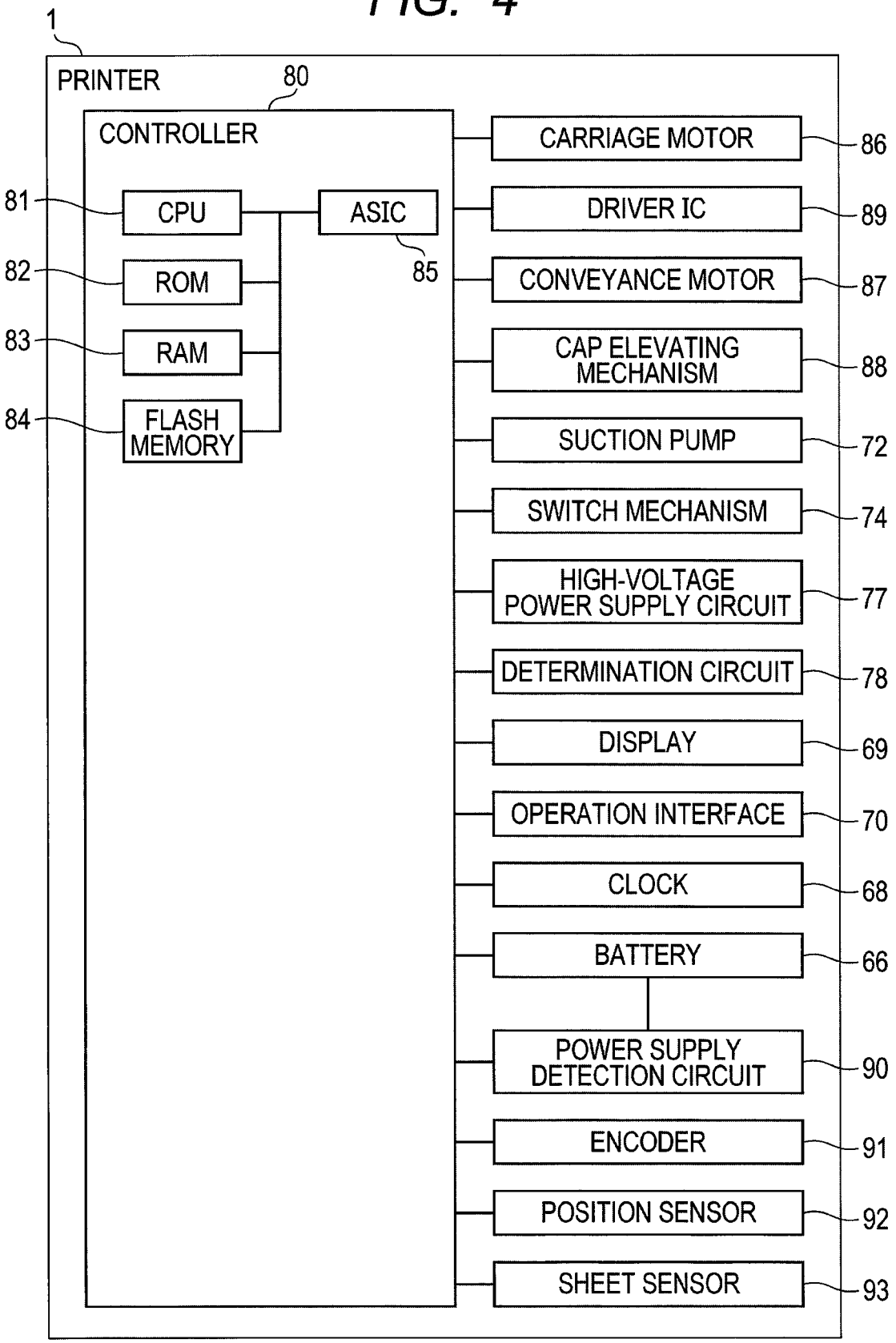
FIG. 4 is a block diagram showing an electrical configuration of the printer.

The maintenance unit 8 includes a cap 71, a suction pump 72, a waste liquid tank 73, and a switch mechanism 74 (see FIG. 4). The cap 71 is arranged at the right side of the platen 5 in the scanning direction. The cap 71 includes a first cap 71*a* and a second cap 71*b*. The first cap 71*a* and the second cap 71*b* are formed integrally. When the carriage 2 is located at a maintenance position at the right side of the platen 5 in the scanning direction, the plurality of nozzles 10 face the cap 71. At this time, the first cap 71*a* is arranged so as to face the nozzle array 9 formed by the plurality of nozzles 10 ("first nozzles") for ejecting black ink. The second cap 71*b* is arranged so as to face the three nozzle arrays 9 formed by the plurality of nozzles 10 ("second nozzles") for ejecting color ink. The maintenance unit 8 (for example, the suction pump 72) is an example of a recovery device.

The cap 71 is configured to be raised and lowered by a cap elevating mechanism 88 (see FIG. 4). When the cap 71 is raised by the cap elevating mechanism 88 from an uncap position below a cap position to the cap position in a state where the plurality of nozzles 10 face the cap 71 by positioning the carriage 2 at the maintenance position, the upper end of the cap 71 is in close contact with the nozzle surface 4*a* and the plurality of nozzles 10 are covered with the cap 71. Thus, the first cap 71*a* covers all the nozzles 10 that eject black ink, and the second cap 71*b* covers all the nozzles 10 that eject color ink. The cap 71 is not limited to a cap covering the plurality of nozzles 10 by being in close contact with the nozzle surface 4*a*. The cap 71 may be a cap that covers a plurality of nozzles 10 by, for example, being in close contact with a frame (not shown) arranged at the periphery of the nozzle surface 4*a* of the inkjet head 4.

The suction pump 72 is a tube pump and so on, and is connected to the cap 71 and the waste liquid tank 73. The switch mechanism 74 is arranged between the suction pump 72 and the cap 71. The switch mechanism 74 is configured to selectively switch between a first connection state between the first cap 71*a* and the suction pump 72 and a second connection state between the second cap 71*b* and the suction pump 72.

The maintenance unit 8 performs a so-called suction purge (recovery operation). In the suction purge, when the suction pump 72 is driven in a state where the first cap 71*a* and the suction pump 72 are connected by the switch mechanism 74 and the plurality of nozzles 10 are covered by the cap 71, black ink in the inkjet head 4 is discharged from the plurality of nozzles 10. When the suction pump 72 is driven in a state where the second cap 71*b* and the suction pump 72 are connected by the switch mechanism 74 and the plurality of nozzles 10 are covered by the cap 71, color ink in the inkjet head 4 is discharged from the plurality of nozzles 10. The ink discharged by the suction purge is stored in the waste liquid tank 73.

The cap may be a cap not divided into the first cap 71*a* and the second cap 71*b* and capable of covering all the nozzles 10 at once. In this case, the maintenance unit 8 need not have the switch mechanism 74, and may perform a suction purge to discharge ink from all the nozzles 10 by driving the suction pump 72. Alternatively, for example, a cap may be provided individually for each nozzle array 9, so that ink is discharged from the nozzles 10 of each nozzle array 9 individually in the suction purge.

Figure 2:
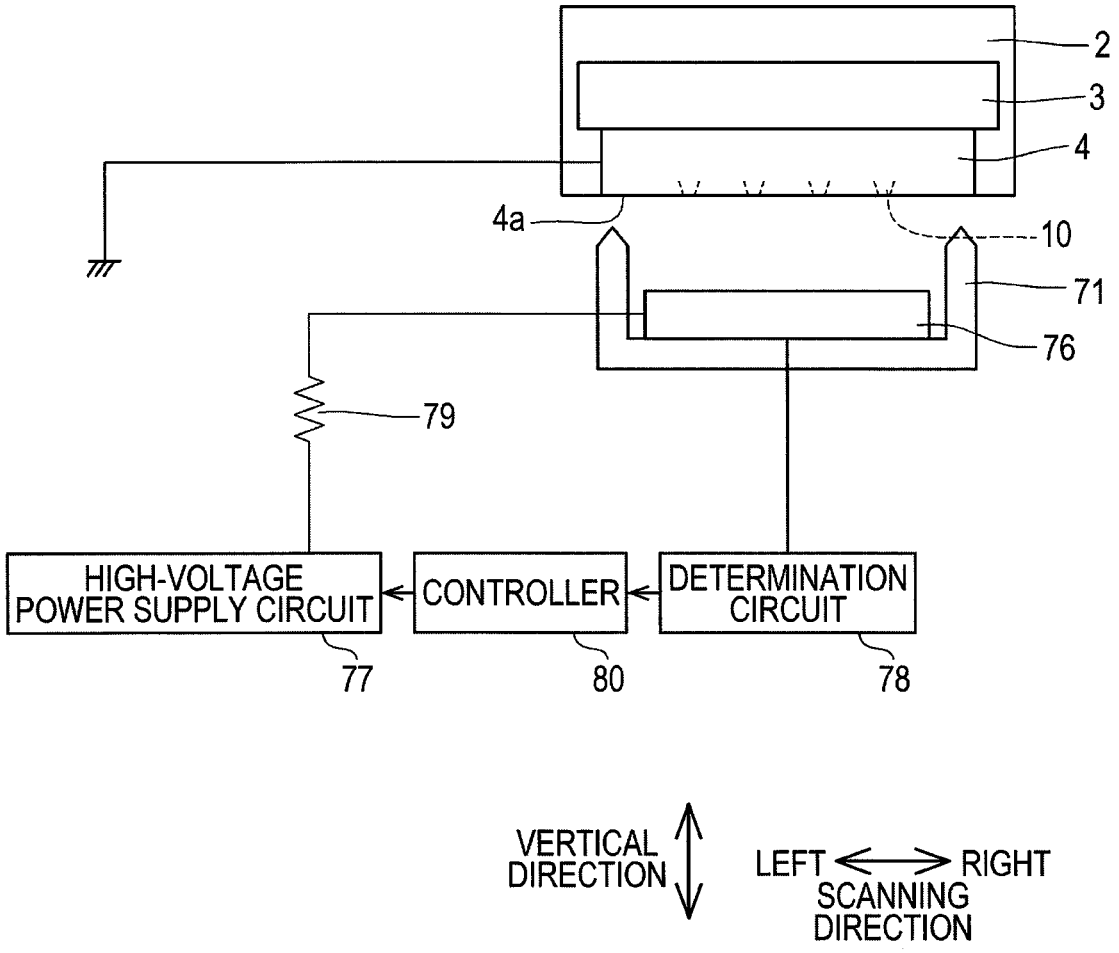
FIG. 2 is a diagram for explaining a detection electrode arranged in a cap and a connection relationship among the detection electrode, a high-voltage power supply circuit, and a determination circuit.

As shown in FIG. 2, a detection electrode 76 having a rectangular planar shape is arranged in the cap 71. The detection electrode 76 is connected to a high-voltage power supply circuit 77 via a resistor 79. A particular positive potential (for example, approximately 600 V) is applied to the detection electrode 76 by the high-voltage power supply circuit 77 at the time of inspection driving described later. The inkjet head 4 is held at the ground potential. As a result, a particular potential difference is generated between the inkjet head 4 and the detection electrode 76. A determination circuit 78 is connected to the detection electrode 76. The determination circuit 78 compares the potential of a signal output from the detection electrode 76 with a threshold value Vt, and outputs a signal according to the result.

Figure 3A:
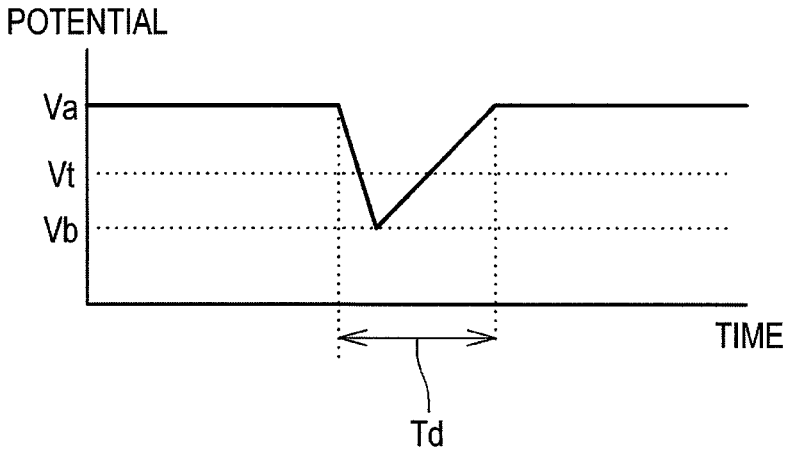
FIG. 3A is a diagram showing a change in a voltage value of the detection electrode when ink is ejected from a nozzle.

More specifically, since a potential difference is generated between the inkjet head 4 and the detection electrode 76, ink ejected from the nozzle 10 is charged. When ink is ejected from the nozzle 10 toward the detection electrode 76 in a state where the carriage 2 is located at the maintenance position, as shown in FIG. 3A, the charged ink approaches the detection electrode 76 and, until the ink lands on the detection electrode 76, the potential of the detection electrode 76 drops from a potential Va at the time when the inkjet head 4 is not driven, and reaches a potential Vb lower than the potential Va. Then, after the charged ink lands on the detection electrode 76, the potential of the detection electrode 76 gradually rises and returns to the potential Va. That is, the potential of the detection electrode 76 changes during a driving period Td of the inkjet head 4.

Figure 3B:
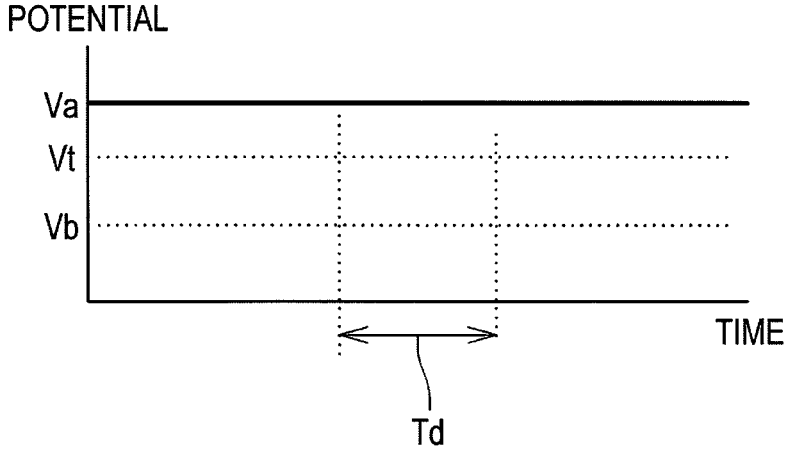
FIG. 3B is a diagram showing a change in the voltage value of the detection electrode when ink is not ejected from the nozzle.

When ink is not ejected from the nozzle 10, as shown in FIG. 3B, the potential of the detection electrode 76 is almost unchanged from the potential Va during the driving period Td of the inkjet head 4. Thus, in the determination circuit 78, a threshold value Vt ($Vb<Vt<Va$) is set in order to distinguish these states. The determination circuit 78 compares the lowest potential of the voltage signal output from the detection electrode 76 with the threshold value Vt during the driving period Td of the inkjet head 4, and outputs a determination signal according to the determination result. In the present embodiment, the combination of the detection electrode 76, the high-voltage power supply circuit 77, the resistor 79, and the determination circuit 78 serves as the "signal output device". This signal output device outputs a determination signal depending on whether the nozzle 10 is an abnormal nozzle from which ink is not ejected. This determination of whether the nozzle 10 is an abnormal nozzle is performed individually for each nozzle.

Here, the high-voltage power supply circuit 77 applies a positive potential to the detection electrode 76. Alternatively, the high-voltage power supply circuit 77 may apply a negative potential (for example, approximately −600 V) to the detection electrode 76. In this case, contrary to the above, when ink is ejected from the nozzle 10 toward the detection electrode 76 in a state where the carriage 2 is located at the maintenance position, the charged ink approaches the detection electrode 76 and the potential of the detection electrode 76 rises from the potential Va until the ink lands on the detection electrode 76 and, after the ink lands on the detection electrode 76, the potential of the detection electrode 76 gradually decreases and returns to the potential Va.

The plug 19 is connectable to a commercial power source (not shown). When the plug 19 is inserted and connected to the commercial power source, power is supplied to the printer 1 from the plug 19. When the plug 19 is unplugged, the power supply from the plug 19 is cut off.

Electrical Configuration of Printer

Next, the electrical configuration of the printer 1 will be described. As shown in FIG. 4, the printer 1 includes a controller 80. The controller 80 includes a CPU (Central Processing Unit) 81, a ROM (Read Only Memory) 82, a RAM (Random Access Memory) 83, a flash memory 84, an ASIC (Application Specific Integrated Circuit) 85, and so on. The controller 80 controls the operations of the carriage motor 86, the inkjet head 4, the conveyance motor 87, the cap elevating mechanism 88, the suction pump 72, the switch mechanism 74, the high-voltage power supply circuit 77, a driver IC 89, and so on. In the present embodiment, the controller 80 controls the inkjet head 4 by controlling the driver IC 89. Further, a determination signal is input to the controller 80 from the determination circuit 78.

In addition to the configuration described above, the printer 1 includes a display 69, an operation interface 70, a clock 68, a battery 66, a power supply detection circuit 90, an encoder 91, a position sensor 92, and a sheet sensor 93. The display 69 is, for example, a liquid crystal display provided on the housing of the printer 1. The controller 80 controls the display 69 to display information and so on necessary for the operation of the printer 1. The operation interface 70 is, for example, a button provided on the housing of the printer 1, a touch panel provided on the display 69, and so on. By operating the operation interface 70, the user inputs a signal to the controller 80.

In the present embodiment, the operation interface 70 includes a power switch (not shown). By operating the power switch, the user switches the power of the printer 1 on and off. When the user operates the power switch of the operation interface 70 to turn on the power of the printer 1, the operation interface 70 outputs a power-on signal indicating that the power of the printer 1 has been turned on, and the controller 80 receives this power-on signal.

The clock 68 measures the time, and the controller 80 receives a time signal indicating the time ("inspection signal") from the clock 68. The battery 66 is connected to at least the controller 80 and the clock 68. In the printer 1, the battery 67 is charged when power is supplied from the plug 19. In the printer 1, in a state where the plug 19 is pulled out and power supply from the plug 19 is cut off, if the battery 67 is not dead, power is supplied from the battery 67 to at least the controller 80 and the clock 68.

The power supply detection circuit 90 is connected to the battery 67 and the controller 80. When the charged amount of the battery 67 reaches a lower limit value for which it is determined that the battery is dead, the power supply detection circuit 90 outputs an abnormality signal indicating an abnormal state to the controller 80. When the battery 67 is dead, the power supply to the clock 68 is cut off, and the clock 68 does not measure the time thereafter. For this reason, a first inspection process described later cannot be normally executed, and the ink in the nozzle 10 may dry out, resulting in an abnormal state in which ejection abnormality occurs. According to the ejection abnormality, ink is not normally ejected from the nozzle 10. As a modification, in a case where the printer 1 is not provided with the battery 67, the power supply detection circuit 90 may be provided in the path through which power is supplied from the plug 19 to the controller 80. In this modification, when power supply from the plug 19 to the controller 80 is cut off, the power supply detection circuit 90 may output an abnormality signal to the controller 80.

The encoder 91 detects the position of the carriage 2 in the scanning direction, and outputs a signal indicating the position of the carriage 2 to the controller 80. The position sensor 92 is a sensor that detects the position of the cap 71. When the cap 71 is located at the cap position, the position sensor 92 outputs, to the controller 80, a signal indicating that the cap 71 is located at the cap position.

For example, when the power of the printer 1 is turned on ("when power is turned on" in this disclosure), the controller 80 receives a power-on signal. At this time, normally, the position of the carriage 2 indicated by the signal from the encoder 91 is the maintenance position, and the position of the cap 71 indicated by the signal from the position sensor 92 is the cap position. However, the power may be turned off while the inkjet head 4 is not capped by the cap 71 for some reason (such as a power failure or the plug 19 being pulled out) before the printer 1 is turned on. In this case, ink in the plurality of nozzles 10 may dry out and an ejection abnormality may occur. When such an abnormal state occurs in the printer 1, the signals received by the controller 80 from the encoder 91 and the position sensor 92 do not indicate the maintenance position and the cap position correctly. These signals ("abnormality signal") indicate an abnormal state.

The sheet sensor 93 is arranged between the inkjet head 4 and the conveyance roller 6 in the conveyance direction. The sheet sensor 93 detects the recording sheet P conveyed by the conveyance roller 6, and outputs, to the controller 80, a signal indicating that the recording sheet P has been conveyed.

For example, if the sheet sensor 93 does not detect the recording sheet P even after a particular time has elapsed from the start of the conveyance of the recording sheet P at the time of recording, a conveyance defect such as a jam has occurred in the recording sheet P. In this case, ink drying of the plurality of nozzles 10 may occur, or the recording sheet P may contact the nozzles 10 and the nozzles 10 may be damaged, resulting in an abnormality in ink ejection from the nozzles 10. When such an abnormal state occurs in the printer 1, the signal (the signal after a particular time has elapsed from the start of the conveyance of the recording sheet P) received by the controller 80 from the sheet sensor 93 do not indicate detection of the recording sheet P, and such signal ("abnormality signal") indicates an abnormal state. The power supply detection circuit 90, the encoder 91, the position sensor 92, and the sheet sensor 93 in the present embodiment are an example of "abnormal-state output device".

In the controller 80, only the CPU 81 may perform various processes, or only the ASIC 85 may perform various processes, or the CPU 81 and the ASIC 85 may cooperate with each other to perform various processes. Further, in the controller 80, one CPU 81 may perform processing independently, or a plurality of CPUs 81 may share the processing. Further, in the controller 80, one ASIC 85 may perform the processing independently, or a plurality of ASICs 85 may share the processing.

Detection of Abnormal State

Next, description will be provided for controls by the controller 80 in the printer 1, indicating the operation at the time of detection for detecting whether an abnormal state has occurred. In the printer 1, at the time of the above detection, the controller 80 performs processing according to the flow of FIG. 5. The flow of FIG. 5 is continued while power is being supplied from the plug or the battery 66 to the controller 80 and the clock 68.

Figure 5:
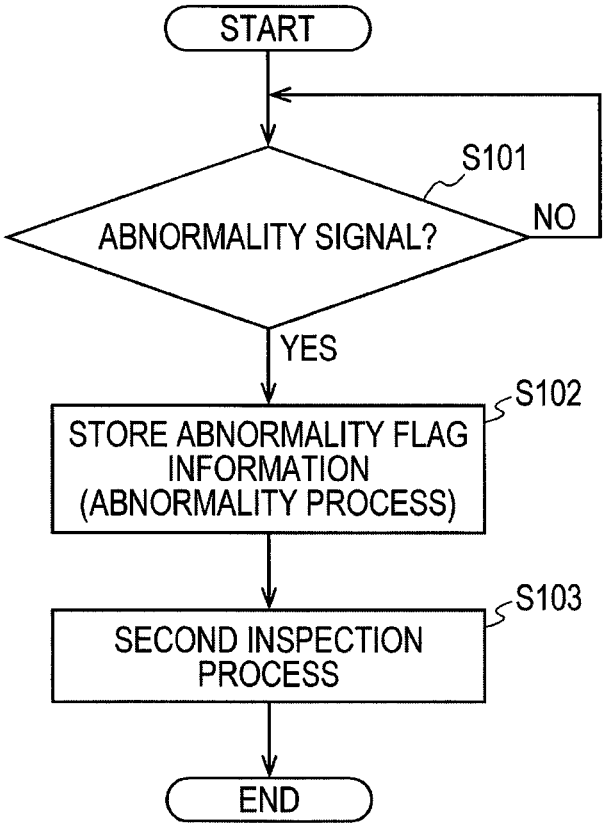
FIG. 5 is a flowchart showing an operation when an abnormal state of the printer is detected.

Explaining the flow of FIG. 5 in more detail, the controller 80 determines whether an abnormality signal has been received (S101). That is, the controller 80 determines whether the power supply detection circuit 90, the encoder 91, the position sensor 92, or the sheet sensor 93 outputs an abnormality signal indicating the above-mentioned abnormal state to the controller 80. When the abnormality signal is received (S101: YES), the controller 80 stores abnormality flag information in the flash memory 84 (S102: "abnormality process"). The abnormality flag information is flag information indicating that the above-mentioned abnormal state has occurred in the printer 1. While no abnormality signal is received (S101: NO), S101 is repeated.

Next, the controller 80 executes a second inspection process (S103). In the second inspection process, the controller 80 controls the inkjet head 4 to be located at the maintenance position, and transmits a drive signal to the driver IC 89 so as to perform inspection driving so that ink is ejected sequentially from the plurality of nozzles 10. At this time, the controller 80 stores inspection history information, which is the information on the time when the inspection driving was performed, in the flash memory 84 based on the time signal from the clock 68. Then, the controller 80 determines whether the nozzle is an abnormal nozzle based on the determination signal output from the determination circuit 78 for each nozzle 10 during the inspection driving ("abnormal nozzle detection"). Then, the controller 80 stores information indicating all the nozzles 10 determined to be abnormal nozzles among the plurality of nozzles 10 in the flash memory 84. That is, the information on the nozzles 10 stored in the flash memory 84 is updated from information indicating the previous abnormal nozzles to information indicating the current abnormal nozzles. In this way, the flow of the abnormal state detection process ends.

Control During Standby

Next, the control by the controller 80 during standby in the printer 1 will be described. In the printer 1, the controller 80 performs processing according to the flow of FIG. 6 during standby. Here, the flow of FIG. 6 is continued while power is being supplied from the plug or the battery 66 to the controller 80 and the clock 68.

Figure 6:
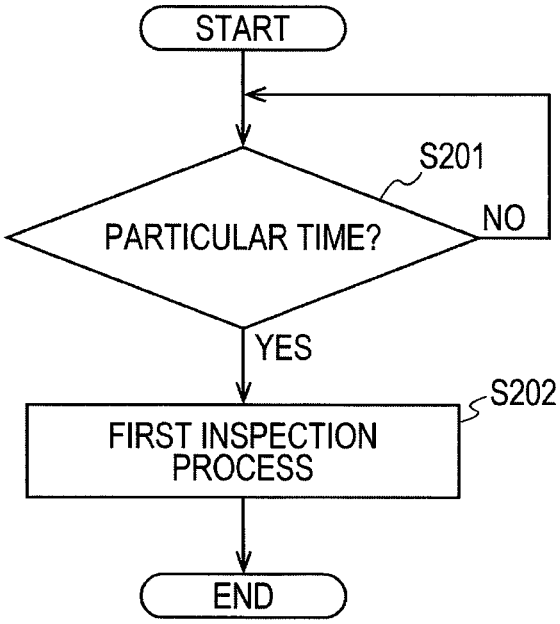
FIG. 6 is a flowchart showing an operation of the printer during standby.

Explaining the flow of FIG. 6 in more detail, the controller 80 determines whether the time signal received from the clock 68 indicates that it is a particular time (S201). While the time signal received from the clock 68 does not indicate that it is the particular time (S201: NO), S201 is repeated. The particular time in the present embodiment may be set to an early morning time such as 6:00 AM, but is not particularly limited.

When the time signal ("inspection signal") received from the clock 68 indicates that it is the particular time (S201: YES), the controller 80 executes a first inspection process (S202). The first inspection process is the same as the second inspection process except that the execution timing is different. That is, the controller 80 stores, in the flash memory 84, inspection history information which is information on the time when the inspection driving was performed, based on the time signal from the clock 68. Then, the controller 80 determines whether the nozzle is an abnormal nozzle based on the determination signal output for each nozzle 10 from the determination circuit 78 during the inspection driving ("abnormal nozzle detection"). Then, the controller 80 stores all the nozzles 10 determined to be abnormal nozzles among the plurality of nozzles 10 in the flash memory 84. That is, the information on the nozzle 10 which is the previous abnormal nozzle stored in the flash memory 84 is updated with the information on the nozzle 10 which is the current abnormal nozzle. In this way, the flow during standby ends.

As a modification of the control flow during standby, after the first inspection process, the controller 80 may perform flushing to eject ink from the nozzle 10 which is an abnormal nozzle indicated by information stored in the flash memory 84. Then, the controller 80 may execute the first inspection process again. By doing so, the nozzle 10 which has become an abnormal nozzle due to the ink in the nozzle 10 being slightly thickened may be recovered, and then the controller 80 may execute the first inspection process again.

Control During Recording

Next, control during recording on the recording sheet P in the printer 1 will be described. In the printer 1, when a recording command signal ("ejection instruction signal: particular signal") instructing printer 1 to perform recording on the recording sheet P is received, the controller 80 performs processing according to the flow of FIG. 7. The recording command signal is a signal instructing the printer 1 to perform recording on the recording sheet P. The recording command signal is transmitted from an external device and so on to the controller 80.

Figure 7:
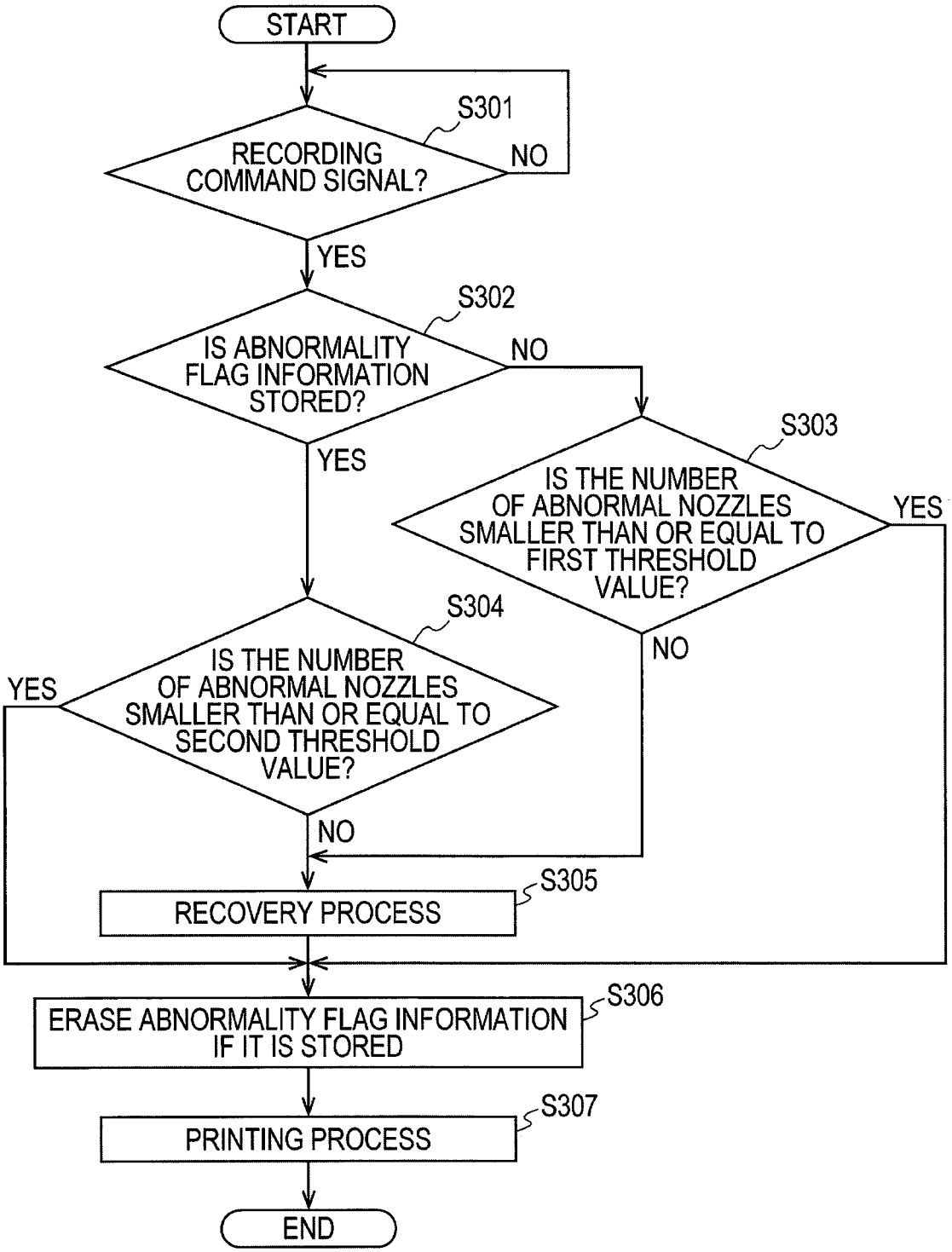
FIG. 7 is a flowchart showing an operation during recording of the printer.

Explaining the flow of FIG. 7 in more detail, the controller 80 first determines whether a recording command signal has been received (S301). While a recording command signal has not been received (S301: NO), S301 is repeated. When a recording command signal is received (S301: YES), the controller 80 determines whether abnormality flag information is stored in the flash memory 84 (S302).

When abnormality flag information is not stored in the flash memory 84 (S302: NO), the controller 80 determines whether the number of abnormal nozzles stored in the flash memory 84 is smaller than or equal to a first threshold value (S303). Under the normal state, the number of abnormal nozzles gradually increases over a long period of time, and then the image quality gradually deteriorates. The first threshold value is predetermined such that a recovery process is executed immediately before the deterioration of the image quality becomes noticeable. The first threshold value individually has a value (for example, 20) for the number of abnormal nozzles 10 for ejecting black ink and a value (for example, 60) for the number of abnormal nozzles 10 for ejecting color ink. The value (for example, 60) for the number of abnormal nozzles 10 for ejecting color ink is the total number obtained by adding the value (for example, 20) for the number of abnormal nozzles 10 for ejecting yellow ink, the value (for example, 20) for the number of abnormal nozzles 10 for ejecting cyan ink, and the value (for example, 20) for the number of abnormal nozzles 10 for ejecting magenta ink. In this way, the controller 80 determines whether any one of the number of abnormal nozzles 10 for ejecting black ink and the number of abnormal nozzles 10 for ejecting color ink exceeds the individual value of the first threshold value.

When abnormality flag information is stored in the flash memory 84 (S302: YES), the controller 80 determines whether the number of abnormal nozzles stored in the flash memory 84 is smaller than or equal to a second threshold value (S304). Under the abnormal state, the number of abnormal nozzles suddenly increases in a short period of time, and then the image quality deteriorates. The second threshold value is predetermined such that a recovery process is executed immediately before the deterioration of the image quality becomes noticeable. Similar to the first threshold value, the second threshold value has a value (for example, 10) for the number of abnormal nozzles 10 for ejecting black ink and a value (for example, 30) for the number of abnormal nozzles 10 for ejecting color ink. The value of the second threshold value for the number of abnormal nozzles 10 for ejecting black ink is smaller than the value of the first threshold value for the number of abnormal nozzles 10 for ejecting black ink. The value of the second threshold value for the number of abnormal nozzles 10 for ejecting color ink is smaller than the value of the first threshold value for the number of abnormal nozzles 10 for ejecting color ink. The value (for example, 30) for the number of abnormal nozzles 10 for ejecting color ink is the total number obtained by adding the value (for example, 10) for the number of abnormal nozzles 10 for ejecting yellow ink, the value (for example, 10) for the number of abnormal nozzles 10 for ejecting cyan ink, and the value (for example, 10) for the number of abnormal nozzles 10 for ejecting magenta ink. In this way, the controller 80 determines whether any one of the number of abnormal nozzles 10 for ejecting black ink and the number of abnormal nozzles 10 for ejecting color ink exceeds the individual value of the second threshold value.

In S303, when at least the number of abnormal nozzles 10 for ejecting black ink or the number of abnormal nozzles 10 for ejecting color ink exceeds the corresponding individual value of the first threshold value (S303: NO), the controller 80 executes the recovery process (S305). In S304, when at least the number of abnormal nozzles 10 for ejecting black ink or the number of abnormal nozzles 10 for ejecting color ink exceeds the corresponding individual value of the second threshold value (S304: NO), the controller 80 executes the recovery process (S305).

In the recovery process in the present embodiment, the controller 80 performs suction purge. At this time, in S303 and S304, among the number of abnormal nozzles 10 for ejecting black ink and the number of abnormal nozzles 10 for ejecting color ink, when only the number of abnormal nozzles 10 for ejecting black ink exceeds the corresponding individual value of the first threshold value, the controller 80 drives the suction pump 72 in a state where the first cap 71*a* is connected to the suction pump 72 such that black ink in the inkjet head 4 is discharged from the plurality of nozzles 10. When only the number of abnormal nozzles 10 for ejecting color ink exceeds the corresponding individual value of the first threshold value, the controller 80 drives the suction pump 72 in a state where the second cap 71*b* is connected to the suction pump 72 such that color ink in the inkjet head 4 is discharged from the plurality of nozzles 10. When both the number of abnormal nozzles 10 for ejecting black ink and the number of abnormal nozzles 10 for ejecting color ink exceed the corresponding individual values of the first threshold value, the controller 80 switches the connection of the suction pump 72 to the first cap 71*a* and the second cap 71*b* sequentially, such that ink is discharged from all the nozzles.

After S305, when both the number of abnormal nozzles 10 for ejecting black ink and the number of abnormal nozzles 10 for ejecting color ink are smaller than or equal to the corresponding individual values of the first threshold value (S303: YES), or when both the number of abnormal nozzles 10 for ejecting black ink and the number of abnormal nozzles 10 for ejecting color ink are smaller than or equal to the corresponding individual values of the second threshold value (S304: YES), the controller 80 erases abnormality flag information when the abnormality flag information is stored in the flash memory 84 (S306).

Next, the controller 80 executes a printing process (S307). That is, the controller 80 controls the conveyance motor 87 based on the recording command signal to cause the conveyance rollers 6 and 7 to convey the recording sheet P to a position where a region of the recording sheet P in which an image is recorded in a first recording pass faces the plurality of nozzles 10 of the inkjet head 4. Then, the controller 80 performs a recording pass of controlling the carriage motor 86 to move the carriage 2 in the scanning direction and controlling the driver IC 89 to drive a plurality of driving elements to cause the inkjet head 4 to eject ink from the plurality of nozzles 10 toward the recording sheet P.

After that, when the recording on one recording sheet P is not completed, the controller 80 controls the conveyance motor 87 to cause the conveyance rollers 6 and 7 to convey the recording sheet P by a particular distance, and then repeats the recording pass operation until recording on one recording sheet P is completed. When the recording of an image on one recording sheet P is completed, the controller 80 controls the conveyance motor 87 to cause the conveyance rollers 6 and 7 to discharge the recording sheet P for which recording has been completed. In this way, the flow during recording ends.

As described above, according to the printer 1 of the present embodiment, when an abnormal state occurs in the printer 1, and the number of abnormal nozzles is larger than the second threshold value (S304: NO), the recovery process of S305 is performed. The second threshold value is smaller than the first threshold value that is used in the normal state in which the abnormal state does not occur. Thus, the recovery process is easily performed even when the number of abnormal nozzles suddenly increases due to the occurrence of an abnormal state, and the deterioration of the image quality is suppressed even when an abnormal state occurs.

When S102 (abnormality process) is executed, the controller 80 executes the second inspection process in S103. After that, when the recording command signal is received in S301 and the number of abnormal nozzles exceeds the corresponding threshold value in S303 or S304, the controller 80 executes the recovery process in S305. In this way, when an abnormal state occurs, the second inspection process is executed, and the nozzle determined to be the abnormal nozzle is stored in the flash memory 84. Then, when the number of abnormal nozzles stored in the flash memory 84 is larger than the second threshold value, the recovery process is performed.

When the number of abnormal nozzles exceeds the corresponding value of the first or second threshold value after the recording command signal is received in S301 and before the printing process of S307 is executed, the controller 80 executes the recovery process. Thus, the recovery process is performed before starting the ink ejection to the recording sheet P. Thus, the image quality is reliably improved.

The controller 80 erases the abnormality flag information in S306 when the abnormality flag information is stored after the recovery process is executed. Thus, when the recovery process is performed, the abnormality flag information is erased from the flash memory 84.

When the controller 80 receives the time signal indicating a particular time in S201, the controller 80 executes the first inspection process in S202.

If the abnormality process of S102 is executed after the first inspection process of S202 is executed and before the recording command signal is received in S301, the controller 80 executes the second inspection process in S103. After that, when the recording command signal is received in S301 and the number of abnormal nozzles exceeds the corresponding threshold value in S303 or S304, the controller 80 executes the recovery process in S305. In this way, when an abnormal state occurs, the second inspection process is executed, and the nozzle determined to be the abnormal nozzle is stored in the flash memory 84. Then, when the number of abnormal nozzles stored in the flash memory 84 is larger than the second threshold value, the recovery process is performed. After the abnormal state occurs, the second inspection process is executed at an early stage.

The first threshold value has a value for the number of abnormal nozzles which are nozzles for ejecting black ink (first nozzle) and a value for the number of abnormal nozzles which are nozzles for ejecting color ink (second nozzle). The second threshold value also has a value for the number of abnormal nozzles which are nozzles for ejecting black ink (first nozzle) and a value for the number of abnormal nozzles which are nozzles for ejecting color ink (second nozzle). Thus, the recovery process is executed when at least the number of abnormal nozzles for ejecting black ink or the number of abnormal nozzles for ejecting color ink exceeds the corresponding value of the first threshold value or the corresponding value of the second threshold value.

The cap 71 includes the first cap 71*a* and the second cap 71*b*. Thus, the nozzles for ejecting black ink and the nozzles for ejecting color ink are individually covered. Thus, the recovery process is performed individually.

When a signal indicating the recording sheet P is not detected is output from the sheet sensor 93 (abnormal-state output device) even if a particular period has elapsed from the start of conveyance of the recording sheet P during recording, the controller 80 recognizes that a signal (abnormality signal) indicating an abnormal state has been output. Thus, the abnormality flag information is stored in the flash memory 84 when an abnormal state occurs in which there is a possibility that a large number of nozzles 10 will become abnormal nozzles due to occurrence of conveyance failures in the recording sheet P and drying of the ink in the nozzle 10.

The power supply detection circuit 90 (abnormal-state output device) outputs an abnormality signal indicating an abnormal state to the controller 80 when the charge amount of the battery 67 reaches the lower limit value for determining that the battery is dead. When the user does not use the printer 1 for a long period of time, for example, by unplugging the plug 19, the battery 67 runs out and the clock 68 does not measure the time thereafter. In such a state, many nozzles 10 may become an abnormal state in which the nozzles are likely to become abnormal nozzles due to drying of the ink in the nozzle 10, and when the abnormal state occurs, the abnormality flag information is stored in the flash memory 84.

Sometimes, the power of the printer 1 is turned off due to various reasons (power failure, unplugging the plug 19, and so on) in a state where the inkjet head 4 is not capped with the cap 71. In this case, when the power of the printer 1 is turned on, the inkjet head 4 is not capped with the cap 71. In this case, the signal received by the controller 80 from the encoder 91 and the position sensor 92 does not indicate the maintenance position and the cap position. The controller 80 recognizes these signals output from the encoder 91 and the position sensor 92 as abnormality signals. Thus, the abnormality flag information is stored in the flash memory 84 when an abnormal state occurs in which there is a possibility that a large number of nozzles 10 will become abnormal nozzles due to drying of the ink in the nozzle 10 without the plurality of nozzles 10 being covered by the caps 71 when the power is turned off.

Next, a printer according to a second embodiment will be described below with reference to FIG. 8. The printer in the present embodiment is the same as the printer 1 of the first embodiment, except for a part of the control during recording. Thus, the same steps as those in the first embodiment are designated by the same reference signs and the description thereof will be omitted.

Control During Recording

Figure 8:
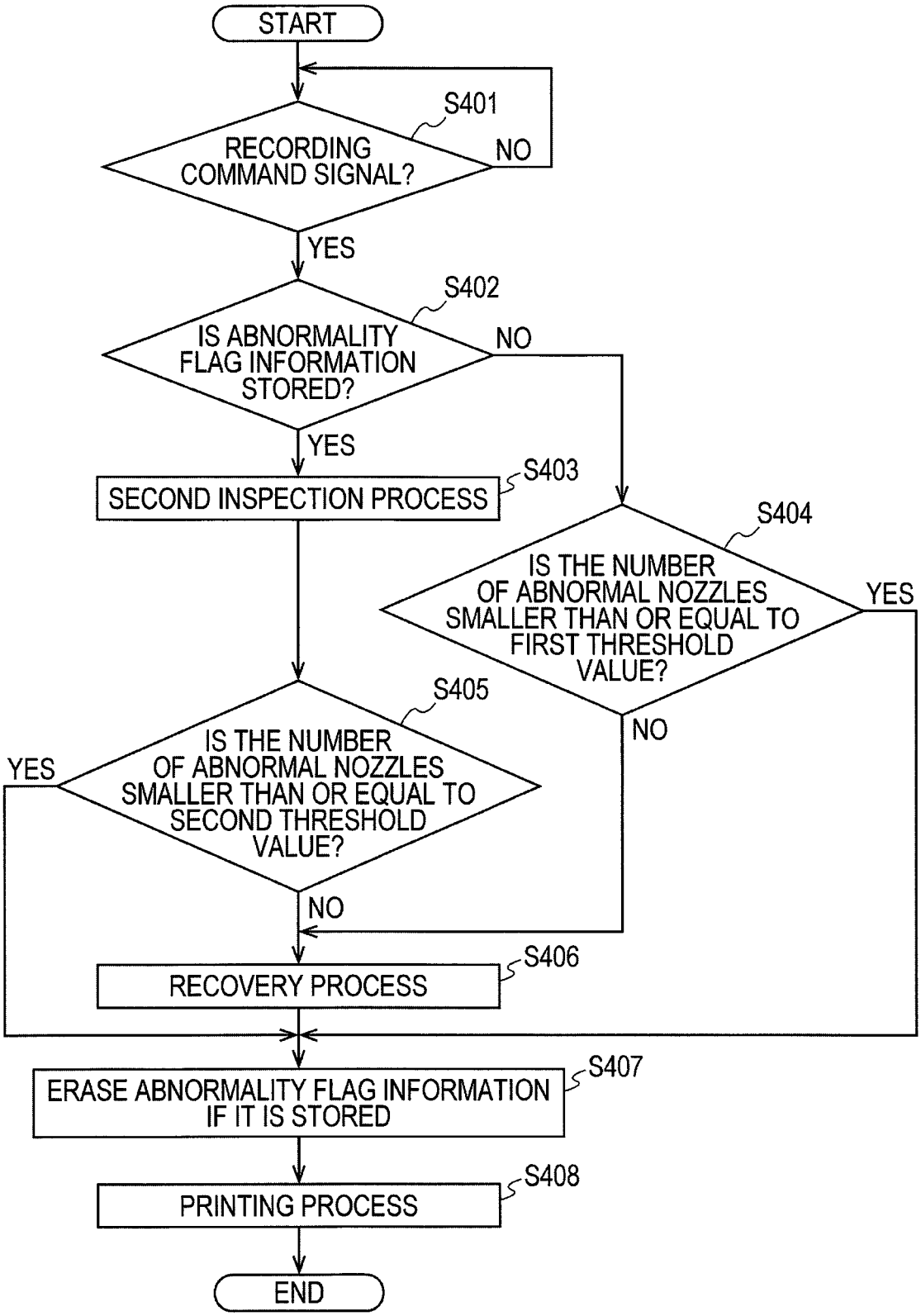
FIG. 8 is a flowchart showing an operation during recording of the printer.

In the printer of the present embodiment, the controller 80 performs processing according to the flow of FIG. 8. First, the controller 80 executes S401 and S402, which are the same as those of S301 and S302 described above.

When abnormality flag information is stored in the flash memory 84 in S402 (S402: YES), the controller 80 executes the second inspection process similar to that in S103 described above (S403). When the second inspection process is executed in S403, S103 described above may be omitted.

When abnormality flag information is not stored in the flash memory 84 in S402 (S402: NO), the controller 80 executes S404 similar to S303 described above.

After S403, the controller 80 executes S405 similar to S304 described above. After that, the controller 80 executes S406 to S408 similar to S305 to S307. In this way, the flow during recording ends.

According to the printer of the present embodiment, when abnormality flag information is stored in the flash memory 84 in S402, the second inspection process of S403 is executed. That is, the controller 80 executes the second inspection process in S403 before the recovery process of S406 is executed, in a case where the abnormality process of S102 is executed after the first inspection process of S202 is executed and before the recording command signal is received in S401. After that, when the number of abnormal nozzles exceeds the corresponding threshold value in S404 or S405, the controller 80 executes the recovery process in S406. In this way, when an abnormal state occurs, the recovery process is executed according to the number of abnormal nozzles detected in the second inspection process of S403 after the recording command signal is received and before the recovery process is executed. Further, the same effects are obtained by the same configuration as in the first embodiment.

In the above-mentioned first embodiment, the second inspection process is performed in S103, but the second inspection process may not be performed. When the abnormality process of S102 is executed after the first inspection processing of S202 is performed and before the recording command signal is received in S301 and when the number of abnormal nozzles stored in the flash memory 84 by the first inspection process is larger than the second threshold value in S304, the controller 80 executes the recovery process in S305. Thus, the determination of whether the recovery process will be executed is determined by using the number of abnormal nozzles by the first inspection process even if an abnormal state occurs after the first inspection process is executed. Thus, it is not necessary to perform abnormal nozzle detection again in the second inspection process.

While the disclosure has been described in detail with reference to the above aspects thereof, it would be apparent to those skilled in the art that various changes and modifications may be made therein without departing from the scope of the claims.

For example, in each of the above embodiments, the printer 1 includes the power supply detection circuit 90, the encoder 91, the position sensor 92, and the sheet sensor 93 as the abnormal-state output device that outputs an abnormality signal serving as a trigger for the controller 80 to execute the abnormality process. However, the printer 1 may include at least one of these elements. Further, an abnormality button may be provided at the operation interface 70, and the user may press the abnormality button for some reason to output an abnormality signal to the controller 80. Further, a temperature sensor may be provided as the abnormal-state output device, and if a signal output from the temperature sensor to the controller 80 indicates a temperature out of a particular temperature range, the signal may be recognized as an abnormality signal.

Each of the first threshold value and the second threshold value may be a value for the total of the number of abnormal nozzles 10 for ejecting black ink and the number of abnormal nozzles 10 for ejecting color ink. That is, the value of the first threshold value may be the total (for example, 80) of a value for the number of abnormal nozzles 10 for ejecting black ink (for example, 20) and a value for the number of abnormal nozzles 10 for ejecting color ink (for example, 60). The value of the second threshold value may be the total (for example, 40) of a value for the number of abnormal nozzles 10 for ejecting black ink (for example, 10) and a value for the number of abnormal nozzles 10 for ejecting color ink (for example, 30). In this case, by providing one cap that covers all the nozzles 10, when the number of abnormal nozzles exceeds the threshold value, a recovery process for all the nozzles 10 is performed at once. In this modification, the switch mechanism 74 may be omitted.

Each of the first threshold value and the second threshold value for the number of abnormal nozzles 10 for ejecting color ink may be an individual value for each color. In this case, by providing an individual cap that covers a plurality of nozzles 10 for each color, a recovery process is performed for the nozzles 10 that eject ink of the color for which the number of abnormal nozzles exceeds the threshold value. That is, the recovery process is performed individually for each color. Thus, it is not necessary to discharge ink from the nozzles for ejecting ink of color for which the number of abnormal nozzles does not exceed the threshold value, and thus the ink consumption is reduced. A switch mechanism in this modification is individually connectable to each individual cap and the suction pump 72.

In each of the above-described embodiments, the trigger for executing the first inspection process is a time signal indicating a particular time, but the first inspection process may be executed by a trigger other than this. Further, in each of the above-described embodiments, the recovery process is performed after receiving the recording command signal. Alternatively, the recovery process may be performed by the user operating through the operation interface 70, or may be performed every time a particular period of time elapses.

In each of the above embodiments, all the nozzles 10 of the inkjet head 4 are driven for inspection, but this disclosure is not limited to this. For example, the inspection driving may be performed only on some nozzles 10 of the inkjet head 4 such as every other nozzle 10 in each nozzle array 9, and it may be estimated for the other nozzles 10 whether it is an abnormal nozzle based on the determination signal output from the determination circuit 78 during the inspection driving.

In the above-described embodiments, the determination circuit 78 outputs a signal indicating whether the nozzle 10 is an abnormal nozzle depending on the potential of the detection electrode 76 when ink is ejected from the nozzle 10 toward the detection electrode 76. However, the method is not limited to this.

For example, a detection electrode extending in the vertical direction may be arranged, and a determination circuit may output a signal indicating whether the nozzle is an abnormal nozzle depending on the potential of the detection electrode when ink is ejected from the nozzle 10 so as to pass through the region facing the detection electrode. Alternatively, an optical sensor ("signal output device") for detecting the ink ejected from the nozzle 10 may be provided, and the optical sensor may output a signal indicating whether the nozzle is an abnormal nozzle.

Alternatively, for example, as described in Japanese Patent No. 4929699, a voltage detection circuit ("signal output device") for detecting a change in voltage when ink is ejected from a nozzle may be connected to a plate of the inkjet head in which nozzles are formed, and the voltage detection circuit may output, to the controller 80, a signal indicating whether the nozzle is an abnormal nozzle.

Alternatively, for example, as described in Japanese Patent No. 6231759, the control board of the inkjet head may be provided with a temperature detection element ("signal output device"). After applying a first applied voltage to drive the heater for ink ejection, a second applied voltage may be applied to drive the heater so that ink is not ejected, and thereafter a signal indicating whether the nozzle 10 is an abnormal nozzle may be output based on the change in temperature detected by the temperature detection element until a particular time elapses.

In the above example, the nozzle 10 from which ink is not ejected is determined to be an abnormal nozzle, but this disclosure is not limited to this. For example, a signal output device for outputting a signal indicating whether the ink ejection direction of the nozzle 10 is normal may be provided, and a nozzle 10 having an abnormality in the ejection direction may be determined to be an abnormal nozzle based on the signal from the signal output device.

A signal output device that outputs a signal indicating the state of the abnormal nozzle other than non-ejection of ink may be provided, and information on the state of the abnormal nozzle may be acquired based on the signal from the signal output device. The state of the abnormal nozzle is, for example, a state that the ink ejection direction is abnormal, splashes occur, air bubbles are mixed, paper dusts are clogged, and so on. At this time, as the inspection driving, pressure may be applied to ink to such an extent that the ink is not ejected from the nozzle 10 such that the ink in the vicinity of the nozzle 10 is vibrated. Then, the signal output device may output a signal indicating the vibration state of the ink in the vicinity of the nozzle 10, thereby acquiring information on the state of the abnormal nozzle.

In the above embodiment, a suction purge is performed in the recovery process, but this disclosure is not limited to this. For example, a pressure pump may be provided in the middle of the tube 15 that connects the sub tank 3 and the ink cartridge 14. Alternatively, the printer may be provided with a pressure pump connected to an ink cartridge. In a state where the plurality of nozzles 10 are covered with the cap 71, the pressure pump may be driven to pressurize ink in the inkjet head 4 and discharge the ink in the inkjet head 4 from the nozzles 10, which is so-called a pressure purge. In a case where the pressure purge is performed for each color, the pressure pump may be provided individually for each color, or a switch mechanism for switching the connection with the pressure pump may be provided. In this case, the pressure pump is an example of the recovery device.

In the purge process, both suction by the suction pump 72 and pressurization by the pressure pump may be performed.

The present disclosure is not limited to recovering an abnormal nozzle by purging. For example, the abnormal nozzle may be recovered by flushing in which the inkjet head 4 is caused to discharge ink from the nozzle 10. In this case, the inkjet head 4 is an example of the recovery device. Alternatively, the abnormal nozzle may be recovered by both purging and flushing. Alternatively, depending on the number of abnormal nozzles and so on, the abnormal nozzles may be recovered by selectively performing either purging or flushing.

In the above example, this disclosure is applied to a printer provided with a so-called serial head, which ejects ink from a plurality of nozzles while moving in the scanning direction together with the carriage, but this disclosure is not limited to this. For example, this disclosure may be applied to a printer provided with a so-called line head extending over the entire length of the recording sheet P in the scanning direction.

In the above example, this disclosure is applied to a printer that ejects ink from nozzles and records on a recording sheet P, but this disclosure is not limited to this. This disclosure may also be applied to a printer that records an image on a recording medium other than a recording sheet, such as a T-shirt, a sheet for outdoor advertising, a case of a mobile terminal such as a smartphone, a corrugated cardboard, and a resin member. This disclosure may also be applied to a liquid ejection apparatus that ejects liquid other than ink, for example, a liquefied resin or metal.

What is claimed is:

1. A liquid ejection apparatus comprising:

a liquid ejection head having a plurality of nozzles configured to eject liquid;

a signal output device configured to output a determination signal when inspection driving is performed by the liquid ejection head;

a recovery device configured to perform a recovery operation of discharging liquid from the plurality of nozzles;

an abnormal-state output device configured to output an abnormality signal when an abnormal state is occurring in the liquid ejection apparatus;

a memory; and a controller configured to:

in response to receiving the abnormality signal from the abnormal-state output device, store, in the memory, abnormality flag information indicating that the abnormal state occurs;

in response to receiving an inspection signal, perform abnormal nozzle detection of performing the inspection driving and detecting an abnormal nozzle based on the determination signal transmitted from the signal output device, the abnormal nozzle being a nozzle having an abnormality in ejection of liquid, the inspection driving being driving the liquid ejection head to eject liquid from the plurality of nozzles of the liquid ejection head for determining whether each of the plurality of nozzles is the abnormal nozzle, the determination signal indicating whether each of the plurality of nozzles is the abnormal nozzle, and store, in the memory, information on the nozzle determined to be the abnormal nozzle among the plurality of nozzles;

in response to receiving a particular signal and determining that the memory does not store the abnormality flag information and that the number of the abnormal nozzle stored in the memory is larger than a first threshold value, control the recovery device to perform the recovery operation; and in response to receiving the particular signal and determining that the memory stores the abnormality flag information and that the number of the abnormal nozzle is larger than a second threshold value, control the recovery device to perform the recovery operation, the second threshold value being smaller than the first threshold value.

2. The liquid ejection apparatus according to claim 1, wherein the controller is configured to:

in response to storing the abnormality flag information in the memory, perform the abnormal nozzle detection and store, in the memory, information on the nozzle determined to be the abnormal nozzle among the plurality of nozzles; and in response to receiving the particular signal, perform the recovery operation.

3. The liquid ejection apparatus according to claim 1, wherein the particular signal is an ejection instruction signal of instructing the liquid ejection head to eject liquid from the plurality of nozzles toward a medium; and wherein the controller is configured to perform the recovery operation at a timing after receiving the ejection instruction signal and before starting liquid ejection to the medium based on the ejection instruction signal.

4. The liquid ejection apparatus according to claim 1, wherein the controller is configured to:

in response to performing the recovery operation and determining that the memory stores the abnormality flag information, erase the abnormality flag information from the memory.

5. The liquid ejection apparatus according to claim 1, further comprising a clock configured to output a time signal indicating time, wherein the inspection signal is the time signal indicating a particular time.

6. The liquid ejection apparatus according to claim 1, wherein the controller is configured to:

in response to storing the abnormality flag information in the memory after performing the abnormal nozzle detection and before receiving the particular signal, perform another abnormal nozzle detection and store, in the memory, the nozzle determined to be the abnormal nozzle among the plurality of nozzles, and then perform the recovery operation.

7. The liquid ejection apparatus according to claim 1, wherein the controller is configured to perform the abnormal nozzle detection in response to storing the abnormality flag information in the memory.

8. The liquid ejection apparatus according to claim 1, wherein the particular signal is an ejection instruction signal of instructing the liquid ejection head to eject liquid from the plurality of nozzles toward a medium; and wherein the controller is configured to perform the abnormal nozzle detection in response to receiving the ejection instruction signal.

9. The liquid ejection apparatus according to claim 1, wherein the controller is configured to:

in response to storing the abnormality flag information in the memory after performing the abnormal nozzle detection and before receiving the particular signal and in response to determining that the number of the abnormal nozzle stored in the memory is larger than the second threshold value, control the recovery device to perform the recovery operation.

10. The liquid ejection apparatus according to claim 1, wherein the liquid ejection head includes:

a plurality of first nozzles configured to eject first liquid; and a plurality of second nozzles configured to eject second liquid, the second liquid being a different type from the first liquid; and wherein each of the first threshold value and the second threshold value is a value to be compared with a total of the number of the plurality of first nozzles determined to be the abnormal nozzle and the number of the plurality of second nozzles determined to be the abnormal nozzle.

11. The liquid ejection apparatus according to claim 1, wherein the liquid ejection head includes:

a plurality of first nozzles configured to eject first liquid; and a plurality of second nozzles configured to eject second liquid, the second liquid being a different type from the first liquid;

wherein the first threshold value includes a first value to be compared with the number of the plurality of first nozzles determined to be the abnormal nozzle, and a second value to be compared with the number of the plurality of second nozzles determined to be the abnormal nozzle; and wherein the second threshold value includes a third value to be compared with the number of the plurality of first nozzles determined to be the abnormal nozzle, and a fourth value to be compared with the number of the plurality of second nozzles determined to be the abnormal nozzle.

12. The liquid ejection apparatus according to claim 11, wherein the recovery device includes:

a first cap configured to cover the plurality of first nozzles; and a second cap configured to cover the plurality of second nozzles.

13. The liquid ejection apparatus according to claim 1, further comprising a conveyor configured to convey a medium to pass through a region facing the plurality of nozzles of the liquid ejection head, wherein the abnormal-state output device is configured to output the abnormality signal when a conveyance abnormality occurs in the medium conveyed by the conveyor.

14. The liquid ejection apparatus according to claim 1, further comprising a clock configured to measure time, wherein the abnormal-state output device is configured to output the abnormality signal when power supply to the clock is being cut off and the clock does not measure time.

15. The liquid ejection apparatus according to claim 1, wherein the recovery device includes a cap configured to cover the plurality of nozzles; and wherein the abnormal-state output device is configured to output the abnormality signal when the plurality of nozzles being not covered by the cap at power-on of the liquid ejection apparatus.

16. The liquid ejection apparatus according to claim 1, wherein the recovery device includes a cap configured to cover the plurality of nozzles;

wherein the liquid ejection apparatus further comprises:

a carriage on which the liquid ejection head is mounted, the carriage being configured to move in a scanning direction perpendicular to a conveyance direction in which a medium is conveyed, the carriage being movable to a maintenance position at which the plurality of nozzles faces the cap; and an encoder configured to detect a position of the carriage in the scanning direction and to output a signal indicating the position of the carriage to the controller, the encoder including the abnormal-state output device; and wherein the abnormal-state output device is configured to output the abnormality signal when the carriage is not located at the maintenance position at power-on of the liquid ejection apparatus.

17. The liquid ejection apparatus according to claim 1, further comprising an abnormality button configured to accept a user's operation, the abnormality button including the abnormal-state output device, wherein the abnormal-state output device is configured to output the abnormality signal when the abnormality button is operated.

18. The liquid ejection apparatus according to claim 1, further comprising a temperature sensor, the temperature sensor including the abnormal-state output device, wherein the abnormal-state output device is configured to output the abnormality signal when a signal output from the temperature sensor indicates a temperature out of a particular temperature range.

19. A liquid ejection apparatus comprising:

a memory; and a controller configured to:

receive an abnormality signal;

in response to receiving the abnormality signal, determine that an abnormal state occurs;

receive an inspection signal;

in response to receiving the inspection signal:

drive a liquid ejection head having a plurality of nozzles to eject liquid from the plurality of nozzles;

detect an abnormal nozzle having an abnormality in ejection of liquid among the plurality of nozzles, and store, in the memory, information on a nozzle detected to be the abnormal nozzle among the plurality of nozzles;

in response to receiving a particular signal and determining that the abnormal state has not occurred and that the number of the abnormal nozzle stored in the memory is larger than a first threshold value, control a recovery device to perform a recovery operation; and in response to receiving the particular signal and determining that the abnormal state has occurred and that the number of the abnormal nozzle is larger than a second threshold value, control the recovery device to perform the recovery operation, the second threshold value being smaller than the first threshold value.

* * * * *